US006158443A

United States Patent [19]

Leman et al.

[11] Patent Number: 6,158,443

[45] Date of Patent: Dec. 12, 2000

[54] LICE COMB ASSEMBLY

[75] Inventors: Glenn A. Leman, N. Attleboro, Mass.; David Crossley, Charlestown, R.I.

[73] Assignee: Health Enterprises, Inc., North Attleboro, Mass.

[21] Appl. No.: 09/327,889

[22] Filed: Jun. 8, 1999

[51] Int. Cl.[7] ..... A45D 24/16; A45D 24/00

[52] U.S. Cl. ..... 132/120; 132/219; 132/102

[58] Field of Search ..... 132/120, 149, 132/150, 147, 125, 154, 219, 102, 104, 119, 121, 148, 152, 901

[56] References Cited

U.S. PATENT DOCUMENTS

| | | | |
|---|---|---|---|
| D. 253,969 | 1/1980 | Whiteman | D28/25 |
| D. 274,658 | 7/1984 | Saferstein et al. | D28/34 |
| D. 275,804 | 10/1984 | Saferstein et al. | D28/34 |
| D. 289,567 | 4/1987 | O'Connor et al. | D28/25 |
| D. 307,192 | 4/1990 | Saferstein et al. | D28/25 |
| D. 353,915 | 12/1994 | Lanne | D30/159 |
| D. 365,662 | 12/1995 | Leman | D28/25 |
| 1,061,831 | 5/1913 | Freese | 132/147 |
| 1,196,959 | 9/1916 | Lewerenz | 132/147 |
| 1,366,762 | 1/1921 | Ault | 132/120 |
| 1,388,955 | 8/1921 | Kozlowsky et al. . | |
| 1,510,512 | 10/1924 | Trachtenberg . | |
| 1,637,083 | 7/1927 | Meltzer | 132/120 |
| 2,122,226 | 6/1938 | Wyman | 132/147 |
| 4,319,594 | 3/1982 | Parker | 132/120 |
| 4,671,303 | 6/1987 | Saferstein et al. . | |
| 4,815,232 | 3/1989 | Rawski | 43/136 |
| 4,819,670 | 4/1989 | Saferstein et al. | 132/156 |
| 5,261,427 | 11/1993 | Dolev | 132/200 |
| 5,636,646 | 6/1997 | Zito . | |

FOREIGN PATENT DOCUMENTS

| | | | |
|---|---|---|---|
| 619381 | 3/1927 | France | 132/147 |
| 2681228 | 3/1993 | France | 132/125 |

*Primary Examiner*—John J. Wilson
*Assistant Examiner*—Robyn Kieu Doan
*Attorney, Agent, or Firm*—Salter & Michaelson

[57] ABSTRACT

A self-contained lice comb assembly including a handle member defining a housing having an interior cavity for holding and storing tools which aid in the removal of nits and lice and/or the cleaning of the lice comb head is provided. The handle housing may preferably support an extracting tool for removing lice and nits from the hair, such as tweezers, and a cleaning tool for removing lice and nits from between the teeth of the lice comb head, such as a brush. The brush and tweezers are removable from within the handle member during use, and are designed to fit within the handle member for storage. The lice comb assembly may also preferably include interchangeable comb heads having different length teeth for treating various lengths and textures of hair. A magnifier for magnifying hair as it passes through the comb teeth, which allows any nits or lice remaining on the hair to be easily viewed by a user may also be provided.

19 Claims, 4 Drawing Sheets

LICE COMB ASSEMBLY

DESCRIPTION

1. Technical Field

The invention relates generally to a lice comb assembly for removing nits and lice, and more particularly to a lice comb assembly having a storage handle for removably supporting implements therein which aid in the elimination of head lice and nits.

2. Background of Related Art

Head lice is a common problem, particularly among school-aged children. Lice are very small insects that attach to hair, especially on the back of the neck and around the ears, and are highly communicable. Signs of infestation include small red marks on the scalp caused by the lice biting, and acute itching. In order to effectively treat head lice it is important not only to get rid of the adult lice, but also to remove any unhatched eggs, or nits, which are deposited by adult females on the head. Although insecticidal shampoos will help rid the scalp of adult lice, the only effective treatment for removing nits is manually. Since adult females can deposit six to ten nits a day, many dozen nits must often be removed daily in order to prevent reinfestation.

The most effective way to remove nits is by examining each individual hair for at least ten days. This can be a painstaking, frustrating and time-consuming process as the nits are very small in size, usually about 0.3 mm, and stick like glue to the strands of hair. Each nit must be grabbed firmly and slid down the hair shaft in order to be removed. Removal can be accomplished by using fingernails, tweezers, or preferably by using specially developed lice combs having very close spacing between the teeth of the comb. One such comb available from the assignee, Heath Enterprises, and the subject of U.S. Pat. Des. No. 365,662 includes a unitary comb having closely spaced comb teeth and a magnifying glass for viewing hair as it passes through the comb teeth. Also included with the comb is a brush designed to remove lice and nits from between the teeth or pins of the comb during use.

Although lice combs have proven to be generally effective, not all combs are suitable for use on all people. In particular, head lice and nits are most easily removed in people having short, curly or thick hair by utilizing a short pin comb, while a long pin comb is well suited to people having long, fine hair. In addition, lice combs are not always effective in removing lice and stubborn nits from the hair and scalp, and in such cases tweezers may need to be utilized.

It is therefore an object of the present invention to provide a compact, self-contained lice comb assembly having multiple implements to aid in the removal of lice and nits.

It is a further object of the present invention to provide a lice comb assembly which can be utilized on people having different textures of hair and which includes tweezers for aiding in the removal of stubborn nits and head lice.

SUMMARY

In accordance with the present invention, there is provided a self-contained lice comb assembly including a handle member forming a housing having an interior cavity for holding and storing tools which aid in the removal of nits and lice and/or the cleaning of the lice comb head. In one embodiment, an extracting tool for removing lice and nits from the hair, such as tweezers, and a cleaning tool for removing lice and nits from between the teeth of the lice comb head, such as a brush, are removably supported within the housing. The lice comb assembly may also preferably include interchangeable comb heads having different length teeth for treating various lengths and textures of hair. A magnifier for magnifying hair as it passes through the comb teeth, which allows any nits or lice remaining on the hair to be easily viewed by a user may also be provided.

BRIEF DESCRIPTION OF THE DRAWINGS

It should be understood that the drawings are provided for the purpose of illustration only and are not intended to define the limits of the invention. The foregoing and other objects and advantages of the embodiments described herein will become apparent with reference to the following detailed description when taken in conjunction with the accompanying drawings in which.

DETAILED DESCRIPTION OF THE ILLUSTRATIVE EMBODIMENTS

Figure 1:
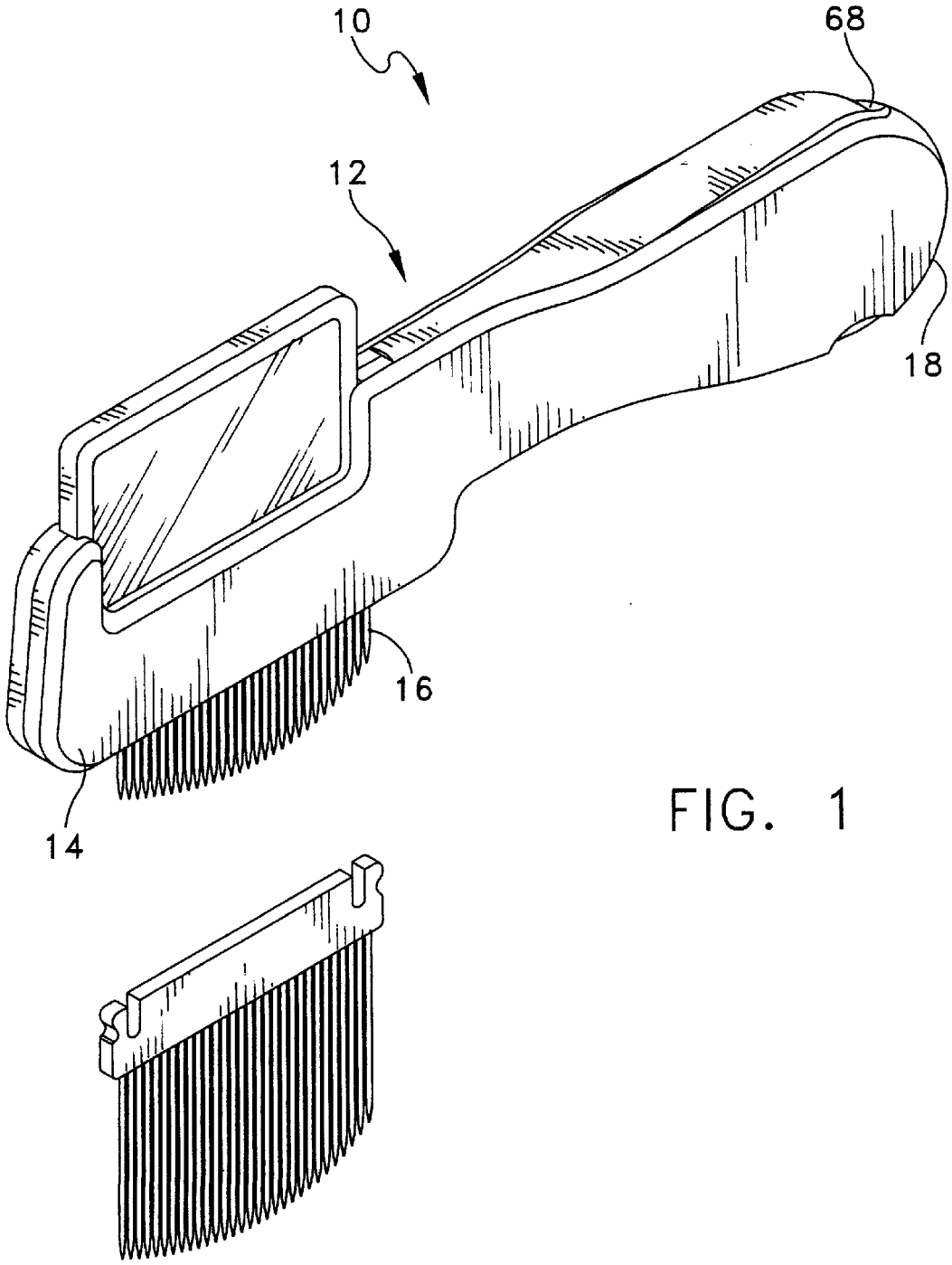
FIG. 1 is a perspective view of a lice comb assembly for removing lice and nits according to the present invention.
Figure 2:
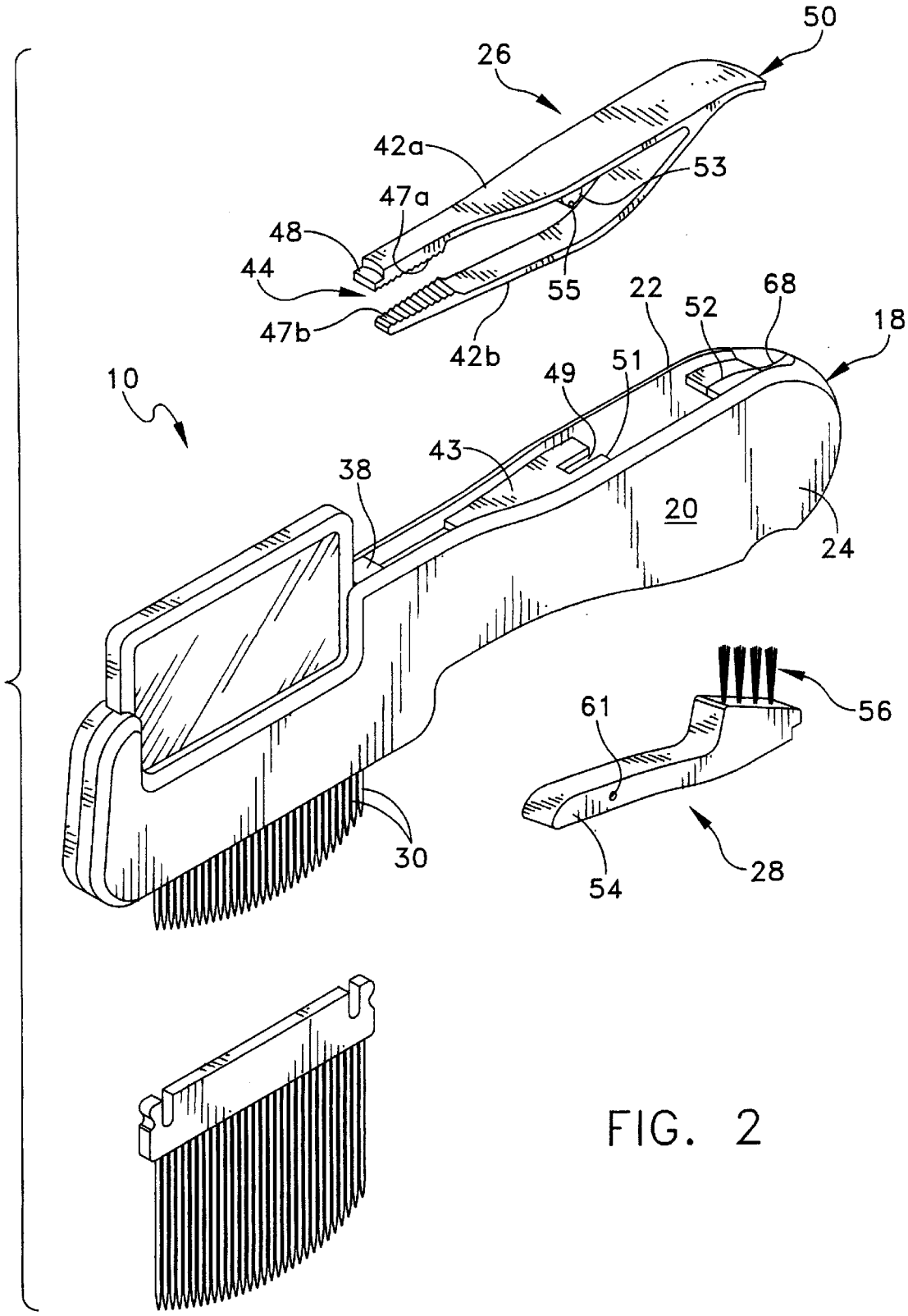
FIG. 2 is an exploded view of the lice comb assembly of FIG. 1 showing its multiple implements for aiding in the removal of lice and nits.
Figure 3:
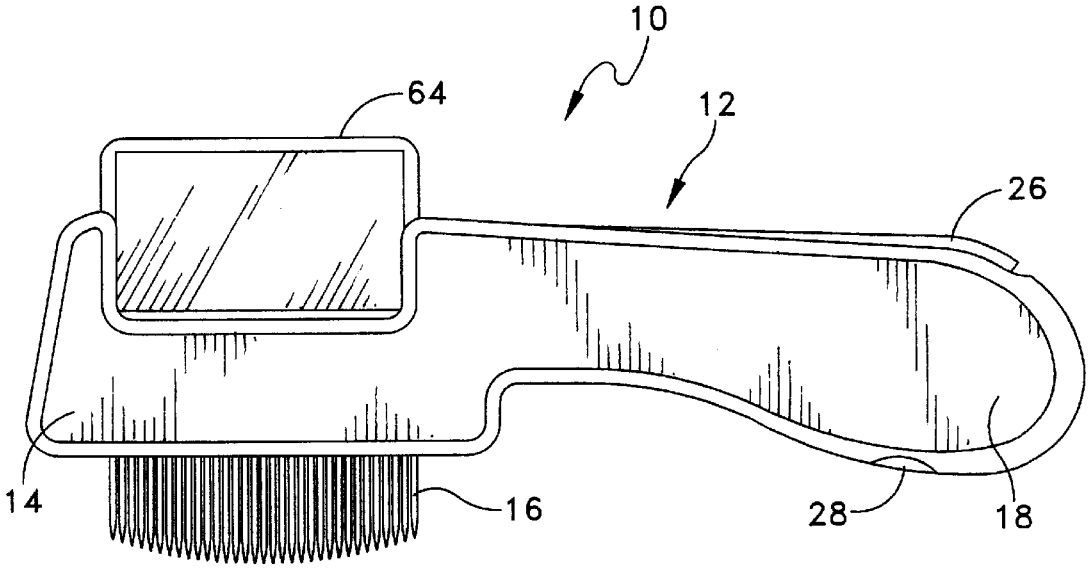
FIG. 3 is a side view of the lice comb assembly of FIG. 1.

A lice comb assembly 10 for removing lice and nits from the hair of a person is illustrated in FIG. 1. The lice comb assembly includes a body 12 having a head portion 14 for supporting a comb head 16 and a handle member 18 for gripping the comb assembly and for housing implements therein. As shown in FIG. 2, the handle member 18 includes a front piece 20 and a back piece 22 formed or secured together to form a housing 24. Removably supported within the handle housing 24 is at least one implement for aiding in the removal of lice and/or nits. The implement may be in the form of an extracting tool 26 for removing lice and nits from the hair, and/or may be in the form of a cleaning tool 28 for removing lice and nits from between teeth 30 of the comb head 16. In the present embodiment, the lice comb assembly includes both a pair of tweezers 26 for removing lice and nits from hair and a brush 28 for removing lice and nits from between the teeth of the comb, both of which are removably supported within housing 24. The brush and tweezers are removable from within the housing during use, and are designed to fit within the handle housing for storage. The housing preferably includes a first opening 32 (FIG. 5) positioned on an outer side of the handle member for receiving tweezers 26 and a second opening 36 positioned on an inner side of the handle member for receiving brush 28. An interior cavity 40 is formed between the front piece 20 and the back piece 22 and is sized to hold both the tweezers 26 and the brush. 28, as shown in FIG. 4.

Referring now to FIG. 2 in conjunction with FIG. 4, the housing may further include a ledge 43 positioned within cavity 40, below opening 32, for supporting tweezers 26 within the housing in an assembled position. Ledge 43 is preferably sized to provide sufficient support to an outer leg 42*a* of the tweezers, and as such includes a first end 45 for engaging a gripping surface 47*a* disposed at a first end 44 of the outer leg. The ledge 43 is also preferably stepped, to follow the contour of the outer leg, and may further include a slot 49 formed in a second end 51 thereof for receiving a detent 53 therethrough. Detent 53 projects downward from an inner surface of the outer leg 42*a,* is sized to fit within slot 49, and preferably includes a projection or nub 55. When tweezers 26 are positioned within the housing in the assembled position as shown in FIG. 4, detent 53 is disposed through slot 49 and nub 55 is positioned below the ledge 43, thus acting as a stop against the ledge to help prevent the tweezers from falling out of the housing.

In the assembled position, the tweezers are preferably supported by housing such that an inner leg 42*b* of the tweezers is positioned within a central portion of the cavity 40 and the outer leg 42*a* is generally flush with a side edge 46 of the comb handle 18. In the present embodiment, outer leg 42*b* may also preferably include a stepped portion 48 at the first end 44 of the tweezers which is designed to fit under a portion 38 of the side edge 46 for further holding the tweezers within the housing. Housing 24 may further include a support member 52 extending from a rear portion of the handle, below the first opening, and positioned within the cavity 40, for supporting a second end 50 of the tweezers within the housing. In this manner, the tweezers 26 are friction fit within the housing such that the tweezers will not fall out of the housing, but may still be readily removed by a user. Alternately, the tweezers may be supported within the housing in any manner which would allow the tweezers to be readily removed by a user while preventing the tweezers from falling out of the housing when not in use, as would be known to one of skill in the art.

Figure 4:
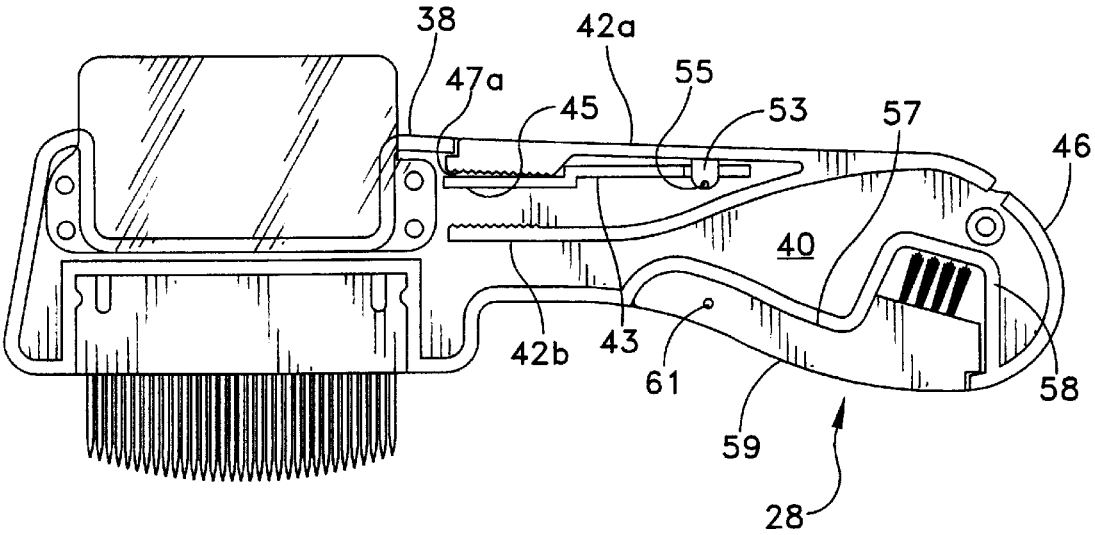
FIG. 4 is a side view of the lice comb assembly of FIG. 1 with a front piece removed so as to show the interior of the head portion and handle of the lice comb assembly.

Brush 28 may likewise be friction fit within housing 24, as shown in FIG. 4. In the assembled position, the brush is preferably positioned within the second opening 36 and is supported by housing such that an inner surface 57 of the brush is positioned within cavity 40, and an outer surface 59 is generally flush with the side edge 46 of the comb handle 18. Housing 24 preferably includes a shoulder 58 for supporting the brush, the shoulder being positioned within the housing cavity, adjacent the second opening, and preferably being contoured to match the inner surface of the brush. Brush 28 includes a handle 54 and bristles 56, the bristles being positioned within cavity 40 in the assembled position. Handle 54 preferably includes a nub 61 on one side thereof which is adapted to engage an inner surface of either the front piece 20 or the back piece 22 of the housing, thus acting as a stop to help prevent the brush from falling out of the housing. In this manner, the brush 28 is friction fit (or snap-fit) within the housing such that the brush will not fall out of the housing, but may still be readily removed by a user. Alternately, the brush may be supported within the housing in any manner which would allow the brush to be readily removed by a user while preventing the brush from falling out of the housing when not in use, as would be known to one of skill in the art. Although tweezers and a brush supported within the handle housing are illustrated in the present embodiment, any number and type of implements may be removably supported within the handle housing, as would be known to one of skill in the art. In addition, various style tweezers and brushes are also within the scope of the present invention.

Figure 5:
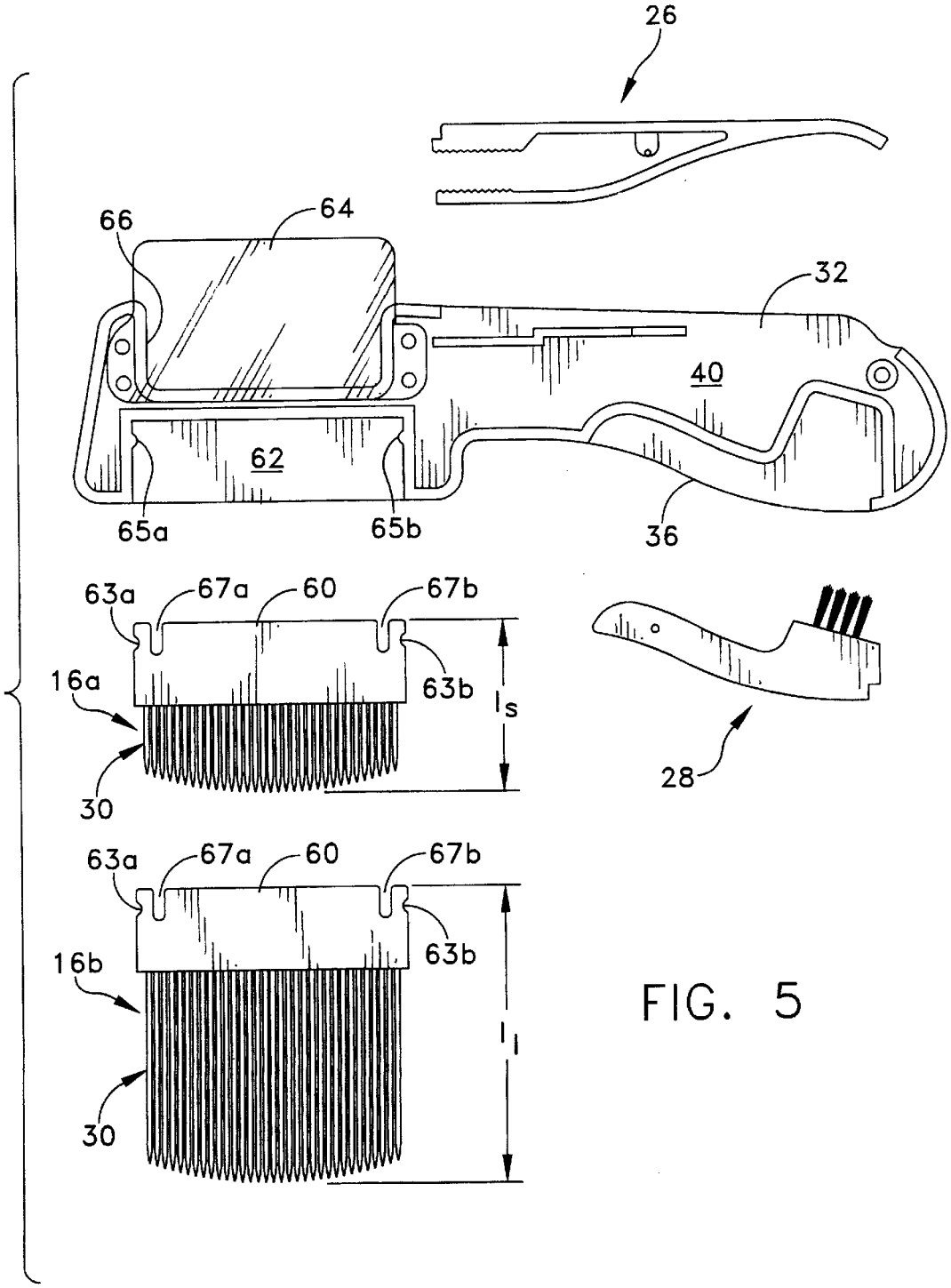
FIG. 5 is an exploded view of the lice comb assembly of FIG. 4, including interchangeable comb heads.

The lice comb assembly may also preferably include interchangeable comb heads having different length teeth for treating various lengths and textures of hair. As shown in FIG. 5, two comb heads 16*a*, 16*b* are preferably provided for use with hairs of different textures and/or lengths. The comb heads each preferably include a plurality of closely spaced teeth 30 arcuately arranged and extending from a base member 60. Base member 60 may be generally rectangular in shape and is designed to be supported within a longitudinally extending slot 62 formed in head portion 14. Comb heads 16*a*, 16*b* may be removably supported within the slot 62 such that the comb heads can easily be pulled from and reinserted into the slot for interchanging comb heads or for cleaning the comb heads. In the present embodiment, base member 60 includes an indent 63*a*, 63*b* on either side thereof for engaging projections 65*a*, 65*b* positioned on either side of slot 62. Base member 60 also preferably includes cutout portions 67*a*, 67*b* which allow the base member to compress slightly during insertion and removal of the comb heads. In use, indents 63*a*, 63*b* engage corresponding projections 65*a*, 65*b* to hold the individual comb heads in place within slot 62, although the comb heads may be removably supported within the head portion in a variety of ways, as would be known to those of skill in the art.

Various types and style comb heads may be provided for use with the present invention. In the present embodiment, comb head 16*a* is a short pin comb having an overall length, "$I_s$" at its longest point of about 1.25 inches and is designed to remove lice and nits from short hair, curly hair and thick hair. Comb head 16*b* is a long pin comb having an overall length, "$l_l$" at its longest point of about 2.2 inches and is designed to remove lice and nits from long hair, straight hair and fine hair. If a person has combination hair, such as long, curly hair, then either comb head may be utilized depending upon the users preference. Since the comb heads are interchangeable, a user who is unsure of which comb head to use can easily try both comb heads in order to determine which is better suited for his or her hair. With either comb head 16*a* or 16*b,* the space between teeth 30 measures about 0.152 mm in order to prevent nits, which have an average size of about 0.3 mm, from passing through the teeth. In the present embodiment, the teeth 30 are also preferably made of metal so that the comb head can be easily boiled and cleaned for reuse. It should be understood that other lengths of the comb heads are contemplated by the present application, as would be known to one of skill in the art.

The head portion 14 of assembly 10 also preferably includes a magnifier 64 supported thereon and positioned on a side opposite the comb head 16. The magnifier 64 is positioned so that as hair passes through the comb head it is magnified, which allows any nits or lice remaining on the hair to be easily viewed by a user. The magnifier 64 may preferably be fixed within a slot 66 in the head portion 14, or it may be removably secured within the slot 66. In the present embodiment, the magnifier may preferably be an extra large 5× magnifying glass. Use of the lice comb assembly for removing lice and/or nits will now be described with reference to the figures.

Prior to use, the appropriate comb head 16*a*, 16*b* is preferably chosen depending upon the length and thickness of the hair to be combed. The base member 60 of the appropriate comb head is then snap-fit within the longitudinal slot 62 so that the comb head will not fall out of the head portion during use. The user then preferably separates a half inch section of hair and holds it with one hand as he/she pulls the comb at about a 45° angle through the section of hair. The user should press the comb teeth as close to the scalp as possible, and lightly comb, passing through the same strands several times. The user should observe the hair as it passes under magnifier 64 to ensure that all lice and/or nits attached to the hair have been removed. If the user detects lice and/or nits remaining on a strand of hair, the user can remove the extracting tool, such as tweezers 26 from within housing 24. To remove the tweezers, the user inserts his or her finger into depression 68 (FIG. 1) and lifts the first end 44 of the tweezers in an upward direction, so as to overcome the force of the friction fit and to disengage the tweezers from within the housing. The serrated gripping surfaces 47*a*, 47*b* of the tweezers may then be utilized to grasp the offending lice and/or nit so that the user can slide the same off the hair. The user can also remove brush 28 from within the housing to clean the lice comb heads, either during or after use, in order to remove any lice and/or nits trapped between the teeth of the comb head. Brush 28 may be removed from within housing 24 by the user inserting his or her finger into depression 70 and lifting the head of the brush in an upward direction, so as to overcome the force of the friction fit and to disengage the brush from within the housing. The user may then use the brush bristles 56 to clean between the teeth 30. Once the user has removed all of the lice and/or nits from the hair, the comb heads must be properly sanitized, preferably by boiling in water, in order to prevent reinfestation. The disassembled comb heads, body, extracting tool and cleaning tool, are all preferably cleaned after use, and the comb heads are preferably immersed in boiling water until any remaining lice and/or nits are killed, for at least about 5 minutes to ensure sterilization.

It will be understood that various modifications may be made to the embodiment disclosed herein. For example, a single comb head which is not removably supported by the head portion may be provided. In addition, a removable extractor may be the only tool stored within the handle portion, or a cleaning tool may be the only tool stored within the handle portion. There may also be a variety of different implements stored within the handle portion, other than the tweezers and/or brush. Therefore, the above description should not be construed as limiting, but merely as exemplifications of a preferred embodiment. Those skilled in the art will envision other modifications within the scope spirit of the invention.

What is claimed is:

1. A lice comb assembly comprising:

a handle member including a front piece and a back piece which together form a housing having an interior cavity disposed therebetween;

a head portion;

a comb head supported by the head portion;

a lice and nit extraction tool removably supported within the interior cavity of the housing; and a magnifier supported on the head portion and positioned on a side opposite the comb head wherein as hair passes through the comb head it is magnified such that a user can easily view the hair and any lice or nits disposed thereon.

2. The lice comb assembly of claim 1, further comprising a cleaning tool removably supported within the interior cavity of the housing.

3. The lice comb assembly of claim 2, wherein the cleaning tool is a brush.

4. The lice comb assembly of claim 1, wherein the extraction tool comprises tweezers.

5. The lice comb assembly of claim 1, wherein the housing further includes a first opening configured and dimensioned to receive the extraction tool therein.

6. The lice comb assembly of claim 5, wherein the extraction tool is friction fit within the housing.

7. The lice comb assembly of claim 6, wherein the housing further includes a second opening configured and dimensioned to receive a cleaning tool therein.

8. The lice comb assembly of claim 7, wherein the cleaning tool is friction fit within the housing.

9. The lice comb assembly of claim 1, wherein the comb head is removably supported within the head portion of the lice comb assembly.

10. The lice comb assembly of claim 9, wherein the head portion includes a longitudinal slot disposed therein for receipt of the removable comb head.

11. The lice comb assembly of claim 10, wherein the comb head includes a set of closely spaced teeth having an elongate shaft portion, a first tapered end, and a second end disposed within a base member which is configured and dimensioned to be received within the longitudinal slot.

12. The lice comb assembly of claim 11, further comprising two or more sets of interchangeable comb heads for receipt within the longitudinal slot.

13. The lice comb assembly of claim 1, wherein the handle and the head portion are formed as a unitary member.

14. A lice comb assembly comprising:

a handle member including a front piece and a back piece which together form a housing having an interior cavity disposed therebetween;

a head portion;

a comb head supported by the head portion;

a cleaning tool removably supported within the interior cavity of the housing; and a magnifier supported on the head portion and positioned on a side opposite the comb head wherein as hair passes through the comb head it is magnified such that a user can easily view the hair and any lice or nits disposed thereon.

15. The lice comb assembly of claim 14, wherein the cleaning tool is a brush.

16. The lice comb assembly of claim 14, wherein the housing further includes an opening configured and dimensioned to receive the cleaning tool therein.

17. The lice comb assembly of claim 14, wherein the cleaning tool is friction fit within the housing.

18. A lice comb assembly comprising:

a handle member including a front piece and a back piece which together form a housing having an interior cavity disposed therebetween;

a head portion;

a comb head supported by the head portion;

a lice and nit extraction tool removably supported within the interior cavity of the housing;

a cleaning tool removably supported within the interior cavity of the housing; and a magnifier supported on the head portion and positioned on a side opposite the comb head, wherein as hair passes through the comb head it is magnified such that a user can easily view the hair and any lice or nits disposed thereon.

19. The lice comb assembly of claim 18, wherein the extraction tool and the cleaning tool are friction fit within the housing.

* * * * *